United States Patent [19]

Gottschling

[11] Patent Number: 4,885,885

[45] Date of Patent: Dec. 12, 1989

[54] JOINT BRIDGING DEVICE

[75] Inventor: Reinhard Gottschling, Essen, Fed. Rep. of Germany

[73] Assignee: Migua Hammerschmidt GmbH, Wulfrath, Fed. Rep. of Germany

[21] Appl. No.: 319,104

[22] Filed: Mar. 6, 1989

[30] Foreign Application Priority Data

Mar. 31, 1988 [DE] Fed. Rep. of Germany ..... 3811082

[51] Int. Cl.[4] ..... E04B 1/68; E01C 11/12; E04C 11/02

[52] U.S. Cl. ..... 52/396; 52/573; 404/47; 404/57; 404/67

[58] Field of Search ..... 404/47, 57, 67; 52/396, 52/573

[56] References Cited

U.S. PATENT DOCUMENTS

| | | | |
|---|---|---|---|
| 3,394,639 | 7/1968 | Viehmann | 404/47 |
| 3,750,359 | 8/1973 | Balzer et al. | 404/57 |
| 3,779,660 | 12/1973 | McGeary et al. | 404/69 |
| 4,504,170 | 3/1985 | Schukolinski | 404/67 |

FOREIGN PATENT DOCUMENTS

| | | | |
|---|---|---|---|
| 1148779 | 6/1983 | Canada | 404/47 |
| 0232203 | 12/1987 | European Pat. Off. | 404/47 |

*Primary Examiner*—James L. Ridgill, Jr.
*Attorney, Agent, or Firm*—Arthur B. Colvin

[57] ABSTRACT

A joint bridging arrangement comprises a bridging unit having a central portion, side parts, and anchoring units adjoining the longitudinal sides of the side parts. The side parts are pivotably connected to the central portion for movement about a pivot axis parallel to the longitudinal axis of the bridging arrangement. Cleats or legs of the side part and anchoring unit are interengaged and relatively slidable at an acute angle relative to the upper side of the center part. The upper-most surface of the bridging unit includes a portion having a wedge shaped cross section corresponding to the acute angle so that the transition from the bridging to the anchoring units, and hence to the structural parts bridged by the joint is essentially stepless.

11 Claims, 7 Drawing Sheets

JOINT BRIDGING DEVICE

BACKGROUND AND FIELD OF THE INVENTION

The invention relates to a joint bridging device comprised of one bridging unit and two anchoring units connected to the respective longitudinal sides of the bridge unit. The anchoring units are each provided on their longitudinal side facing the bridging unit with a laterally open groove which the bridging unit engages.

In such an arrangement, known from German DE-P No. 35 29 877, the bridging unit consists of two bridging parts which can be pushed into each other in the manner of a telescope, in a direction perpendicular to the longitudinal joint extension one part of which, in cross section, is shaped like a tuning fork. This part accepts between its shanks the other which in cross section is shaped rectangularly. The outer margin strips of the bridging parts facing away from each other are shaped like cylinders and are supported in correspondingly halfshell-shaped grooves of the anchoring units.

With the known arrangement not only the bridging of a joint changing in widths between two structural parts can be maintained but also a leveling compensation can take place if, for example, the connected structural parts forming a floor shift relatively to each other in a vertical direction. While the anchoring units are rigidly connected at the longitudinal joint margins with the particular structural parts, the bridging unit can only execute a swiveling motion about the center axis of the bearing shells formed by the grooves in the anchoring units, if the structural parts change their level relative to each other. Thereby a relatively smooth transition from the surface of a structural part to that of another is achievable. Following a change of the joint width the bridging action is maintained so long as the bridging parts remain more or less deeply telescopingly engaged.

Depending on the cross sectional thickness of the bridging parts a more or less pronounced step is perforce generated in the region of the transition from one structural part to the other. In order to be able to keep the height of such a step at a minimum it is known from German DE-OS No. 30 15 011 to dimension the cross section thickness of the bridging parts in such an arrangement smaller than is required by the moment of flexion expected from the loads. To permit use of the arrangement in highly stressed areas such as in floors of storage halls, supermarkets and others, having floor areas carrying wheel loads of fork lift stackers or the like without deformation of the bridging parts, the known arrangement provided for a support rail fixedly clamped in at one of the longitudinal joint margins through which at least one bridging part is underpinned. In order to take changes of the joint width into consideration the support rail can be fixedly clamped to one marginal strip and may only extend over the minimum joint width to be expected. Consequently, the laterally freely projecting support rail must be able to accept an increased stress with the incnreasing joint width which results from the load being introduced in the region furthest removed from the clamping side. The moment of flexion resulting therefrom requires not only a support rail with correspondingly large section modulus but also clamping means which resist the leverages to be expected.

In a bridging arrangement known from German DE-P 31 51 516 the bridging parts are stabilized by a support rail which is slid bilaterally with one longitudinal margin strip in each instance into a groove which is provided in the bridging parts themselves. Springs which at both sides are clamped between the support rail and the bottom of the grooves hold the support rail always in the center of the joint independently of the state of width of the joint. While the bridging parts rest with undersides on the support rail, the upper side of the bridging parts forms a common tangent to both of their cylinder-shaped margin strips held in the bearing shells. Since, lastly, the bridging parts in the area of their interlocking margin strips have fret-shaped edges in horizontal projection and are congruent, so that with the teeth of the one bridging part, meshing with tooth gaps of the other bridging part, continuous steps in the transition region of the bridging parts can also be avoided. Instead, however, depending on the state of width of the joint, breaches of greater or lesser size corresponding to the parts of the tooth gaps are not filled out by teeth. Accordingly water and dirt can penetrate into this construction whereupon the durability and the ability to function are considerably impaired. A sealing of the described construction can, however, only be achieved with considerable additional expenditures and the sealing effect can only be provided below the interlocking bridging parts which remain unprotected even after the expensive sealing measures.

SUMMARY OF THE INVENTION

It is an object of the invention to provide an arrangement of the initially described type whereby a largely steplessly smooth transition from one structural area to another can be achieved and, in addition, a simplified support system is created in which breaches do not occur at any degree of joint expansion so that effective sealing of the joint results.

More particularly, the invention relates to an elongate joint bridging device comprising a center portion, the margins of which are pivotably connected to side portions, the side portions in turn being of two part construction, said parts being laterally shiftably connected to each other as a result of the provision of internesting generally U-shaped overlapping portions arranged at an acute angle relative to the plane of the upper surface of the center portion.

According to the invention a tripartite bridging unit is in itself articulated, and engaged with side anchoring units provided with slots which the side parts of the bridging unit slidably engage. Centering springs may be interposed between the anchoring unit and sides of the bridging unit. The bridging unit permits dimensioning the upper most cleats or legs of the bridging or the anchoring units relatively thin and the underlying cleats or legs of the bridging unit or the anchoring units in a thickness sufficient for the transmission of the forces to be expected since the entire force transmission takes place from the bridging unit to the two anchoring units via the last mentioned cleats. Since, furthermore, according to the invention the inner surfaces of the slots facing the wide sides of the cleats are planar or concave or convex and extend essentially at an acute angle to the upper side of the center part of the bridging unit, the precondition is created of forming the upper cleats of the bridging unit or the anchoring units with a wedge shaped cross section tapering toward the outside or inside corresponding to the inclination of the inner surface. Thereby the thickness of the ends of the upper cleats can even approximate zero and its upper side can, consequently, adjoin the upper sides of the anchoring units or that of the side parts of the bridging unit without forming steps or interruptions. For this purpose it is sufficient that the particular underside of the upper cleats of the bridging unit or the anchoring units as appropriate also extends at an acute angle complemental to the part which received it.

It should be understood that it is advisable to form the margin edges of the upper cleats of the bridging unit or the corresponding cleats of the anchoring units not in the manner of a knife-edge but rather to round them off with a small radius whereby no sharp interference in the smooth transition occurs.

For stability of the construction according to the invention, in any case, no support element extending across the width of the joint is required. Moreover, breaches or openings in the bridging unit are avoided so that with the bridging arrangement a tight joint covering is achievable.

According to one implementation of the invention the anchoring unit has a connection gradient section approximately U-shaped in cross section with shanks inclined convergingly toward the center of the device the lower shank forming a contact surface for the side parts of the bridging unit being longer than the upper shank and projecting into a slot on the side of the bridging unit.

The bearing shells of the side parts which are partly cylindrical preferably encompass the cylinder-shaped margin strips of the center part by more than 180° so that detachment of the center part from the margin strips is prevented. Preferably the part cylinder form of the margin strips encompass approximately 270° of the cylindrical portions of the center member. Thus, the center part on its underside need not be notched in too far, while still retaining a sufficient swiveling range for the individual parts of the bridging unit whereby even extremely large settling motions of structural parts can be accommodated.

If the inner surfaces of the sliding joints instead of the form of inclined planes, extend arc-shaped in a large radius, wherein the lowest or highest point of the arc lies preferably perpendicularly below the center axis of the bearing shells which form the side parts, the level change of the surface of the bridging unit can be even more strongly retained upon a change of the joint width than is the case with completely planar acutely angled inner joint surfaces.

In order to inseparably interconnect all individual parts of the device in a direction perpendicular to the length thereof, a further implementation of the invention provides that legs defining the respective slope include lugs which block separation.

The embodiment also ensures that in a possible jamming of the bridging unit with one of the two anchoring units the parts are not separable in an inward direction.

According to a further embodiment of the invention each anchoring unit consists of a connection gradient section and a separate angle-shaped base gradient section. The base gradient section has a horizontal shank forming a base plate, from which two parallel, vertically directed shanks extend. The shanks run perpendicularly to the length of the joint and engage undercut recesses of the lower cleats of the connection gradient section.

This embodiment permits use of a standard connection gradient section which can be combined with different base gradient sections which differ in shank height. In this way, for example, the device may be adapted to different floor covering thicknesses. The gradient section leads to a stable positioning of the connection gradient section which thereby can also resist a tilting load.

According to a further embodiment each connection gradient section is composed of two cleats detachably connected with each other.

Through this embodiment the gradient section parts forming the lower element of the anchor portion can be mounted beforehand at the structural parts to be bridged. Thereafter, by screwing together the gradient section parts forming the second shank together with the bridging unit the completion of the arrangement can be effected at a later stage of the construction.

DETAILED DESCRIPTION OF THE DRAWINGS

Figure 1:
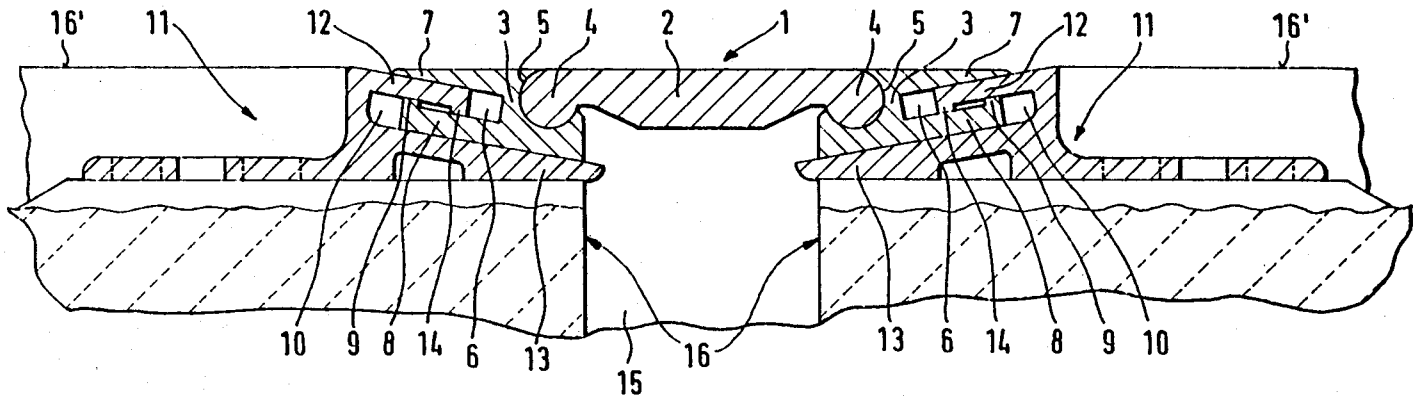
FIGS. 1–7 represent vertical sectional views of different embodiments of the bridging device of the invention installed on adjacent structures to be bridged.

In the various views parts having the same or similar function are given like reference numerals.

FIG. 1 shows an arrangement with a bridging unit 1 which is composed of a center part 2 approximately rectangular in cross section and two side parts 3 articulatedly connected to the center part. To this end two longitudinally extending margin strips 4 of the center part 2 are formed partly cylinder-shaped and held in correspondingly shaped bearing shells 5 of the side parts 3.

In addition to a bearing shell 5 a slot 6 is provided in each side part 3, the inner surfaces of the slot defined by cleats or legs 7,8 extending at an acute angle obliquely to the arrangement center. While the cleat 7, which in each instance is the upper, decreases in cross section toward the outside in the manner of a wedge, the lower cleat 8 is provided with a lug 9 pointing upward and narrowing the opening cross section of the slot 6. Each side part 3 of the bridging unit 1 engages with its cleat 8 a slot 10 of an anchoring unit 11. The inner surfaces of the slot 10 are defined by cleats or legs 12 and 13. The arrangement thus comprises a pair of nesting U shaped members. The upper cleat 12 is provided with a lug 14 pointing downward, and the lower cleat 13 extends in its width at both sides beyond the width of the cleat 8 and functions as an oblique support and slide plate whose plane is inclined toward the center of the bridging unit 1.

If the width of a joint 15 between two structural parts 16 covered by the arrangement changes or if one of the structural parts 16 changes its level relative to the other, in both cases a smooth transition without step formation from one structural surface 16' to the other is retained.

Figure 2:
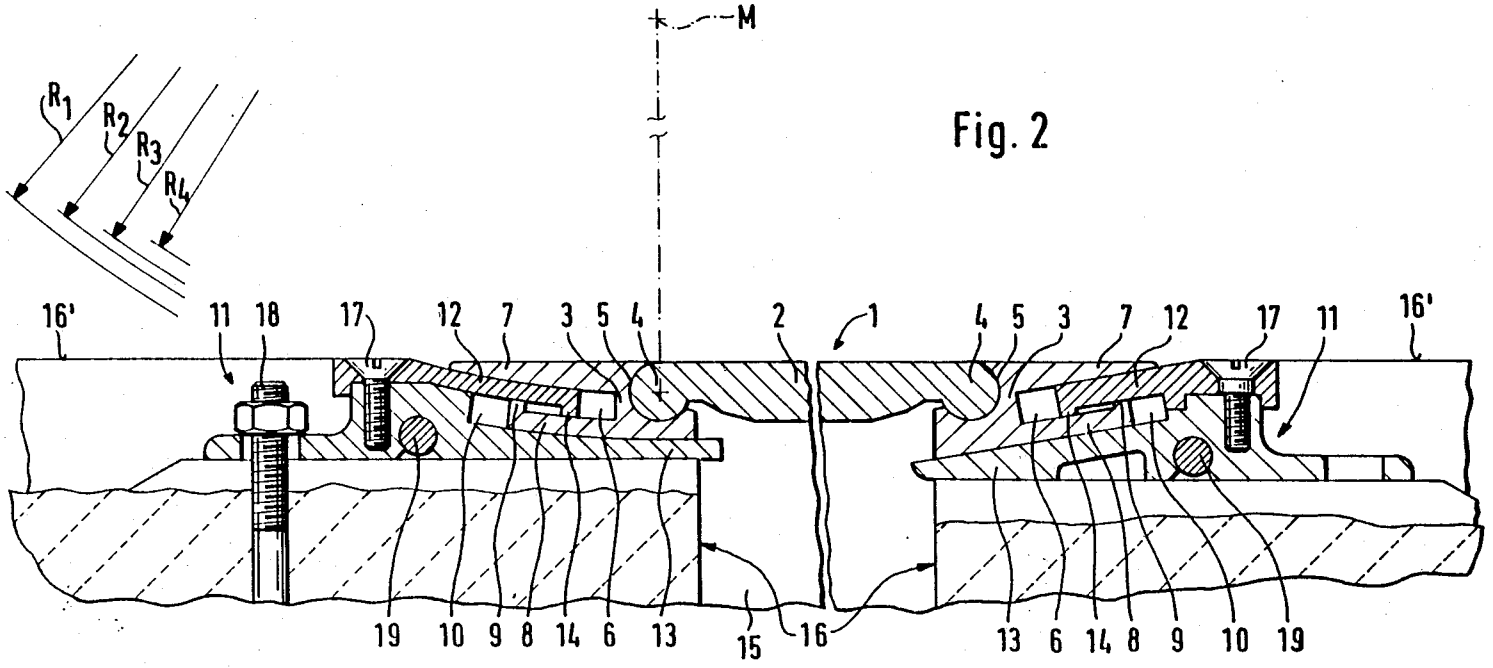

FIG. 2 shows an embodiment similar to FIG. 1 but differing in two areas:

For one, each anchoring unit 11 is not formed in one piece but rather is composed of cleats or legs 12 and 13 detachably connected with each other, for which purpose countersunk flat head screws 17 are distributed over the longitudinal extent of the device in appropriate bores of cleats 12 and screwed into threaded bores of cleats 11.

Furthermore, each anchoring unit 11 is fastened with bolts 18 to a respective part 16, and 16' and the internal surfaces of slots 6 and 10 extend convexly or concavely in large radii $R_1$ to $R_4$ about a center M, wih the center M lying in a plane perpendicular to the upper side of the device and extending through the center axis of the associated bearing shell 5.

Lastly, press-fit pins 19 are driven into front-face bores of cleats 13 whereby sequential lengths of the device can be joined flush to another in known manner to bridge areas of varying lengths.

Figure 3:
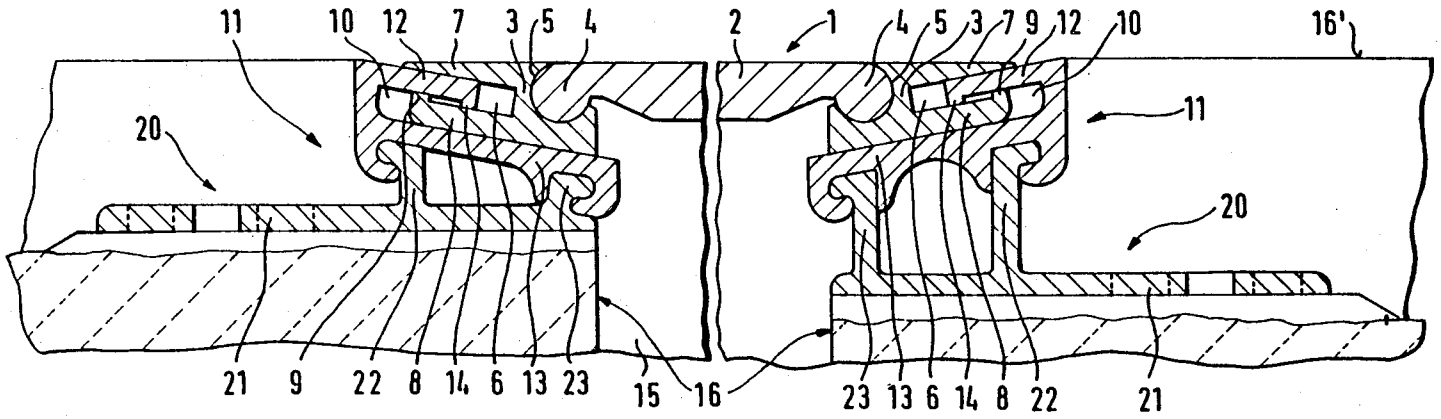

FIG. 3 shows an embodiment with a bridging unit according to FIG. 1, wherein each anchoring unit 11 is comprised of a base gradient section 20 which consists in each instance of a foot piece or mounting base 21 and vertically aligned shanks 22, 23 arranged thereupon extending to different heights which form-fittingly engage grooves of the lower shank 13 of the particular anchoring unit 11.

Figure 4:
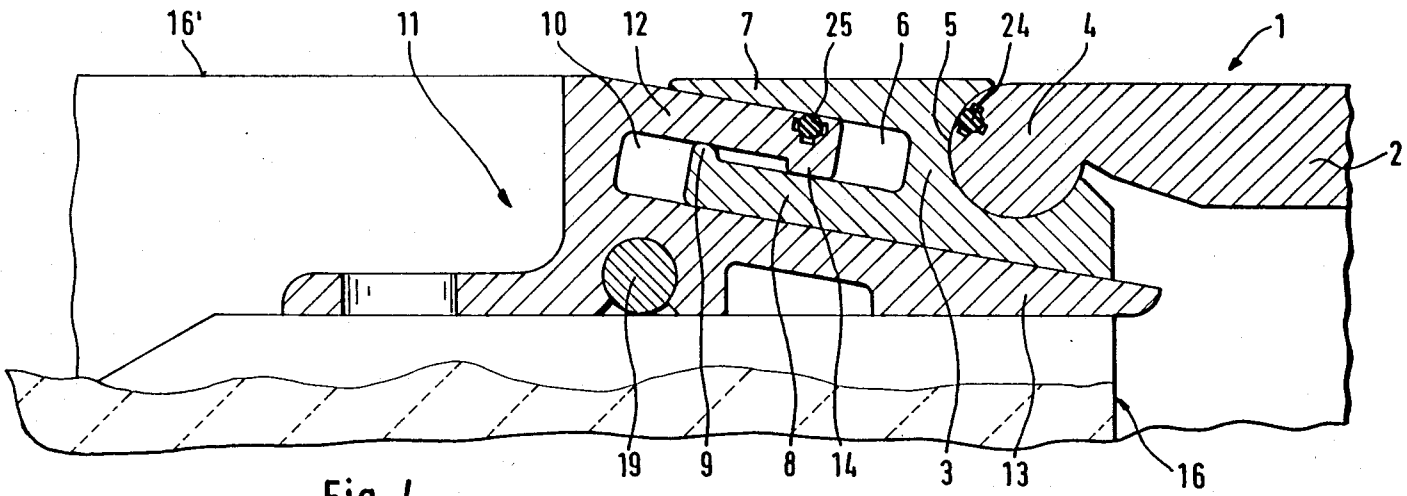

FIG. 4 shows in an enlarged scale a left half of the arrangement according to FIG. 1, in which in the cylinder-shaped margin strip 4 of the center part 2 of the bridging unit 1 as well as also in the upper cleat 12 of the anchoring unit 11 an elastic sealing cord 24 or 25 is embedded which forms between these parts and the bearing shell 5 and the cleat 7 respectively a sealing line so that the device is rendered water tight.

Figure 5:
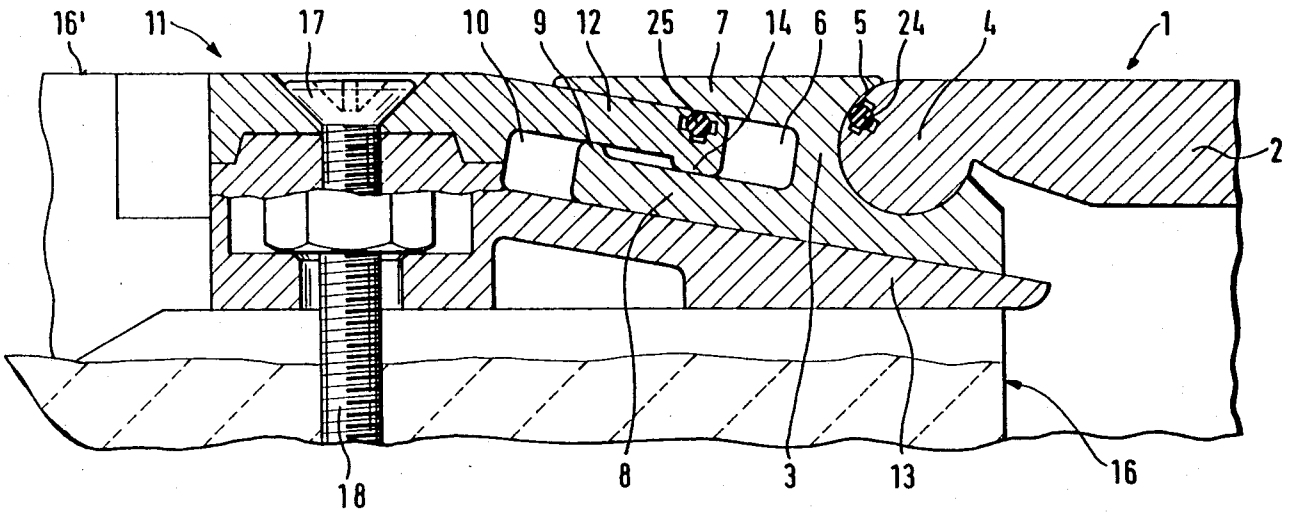

FIG. 5 shows in enlarged scale the left half of the arrangement essentially similar to the right half represented in FIG. 2, in which the same sealing measures as shown in FIG. 4 have been taken. FIG. 5 makes clear in particular that the counter sunk flat head screws 17 can be arranged for connecting cleats 12 and 13 on the same line as the screw bolts 18 for fastening the anchoring units 11 on the structural parts 16.

Figure 6:
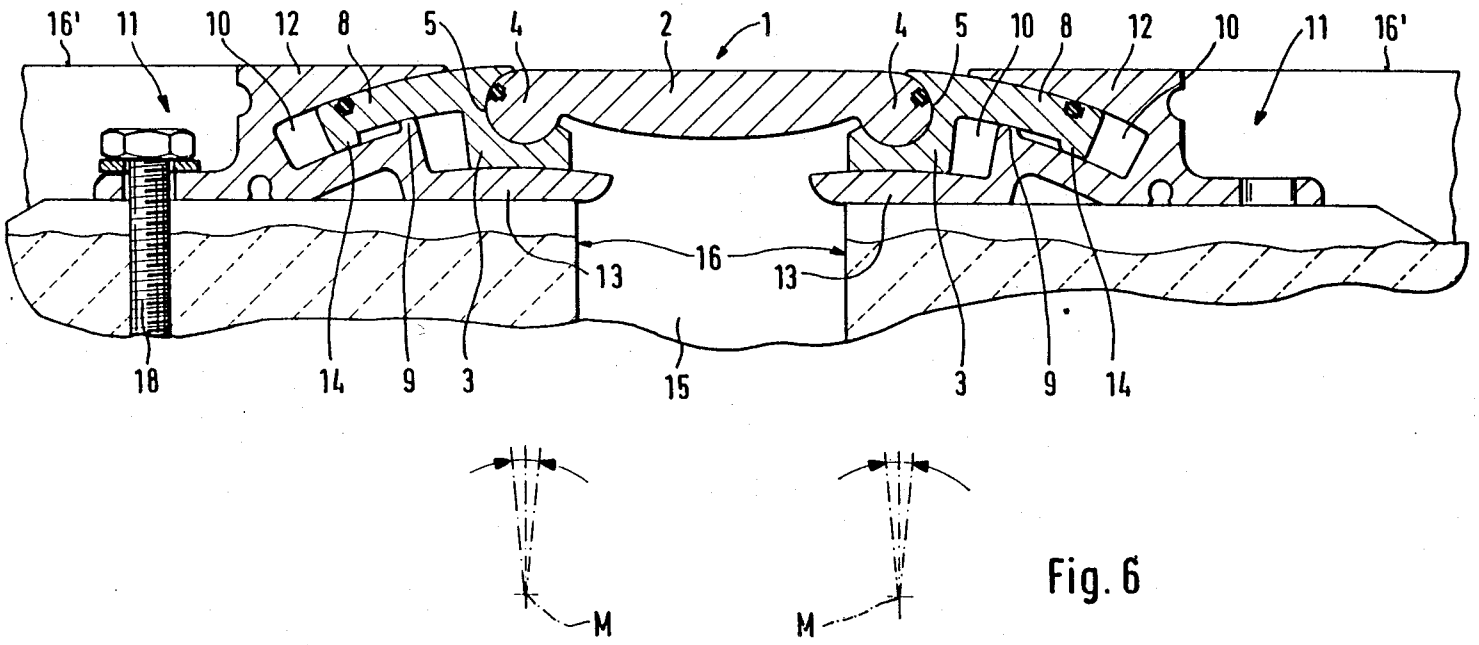

In the embodiment example according to FIG. 6 the two side parts 3 of the bridging unit 1 are each provided with only one cleat 8 which engages a slot 10 of the anchoring unit 11. The inner surfaces of slot 10 and also the side surfaces of cleat 8 extend in great concave or convex arches about a center point M, with this point lying in a plane perpendicular to the upper side of the device and extending through the center axis of the associated bearing shell 5, the axis in this instance lying correspondingly below the level of the structural surface of cleat 13, upon which a correspondingly conversely curved surface of the side part 3 of the bridging unit 1 rests. Cleat 12 of each anchoring unit 11 tapers in cross section approximately wedge-shaped toward the joint center so that with cleat 12 a smooth transition is accomplished as in the embodiment examples of FIGS. 1 to 5 with cleat 7 of the side parts 3.

Figure 7:
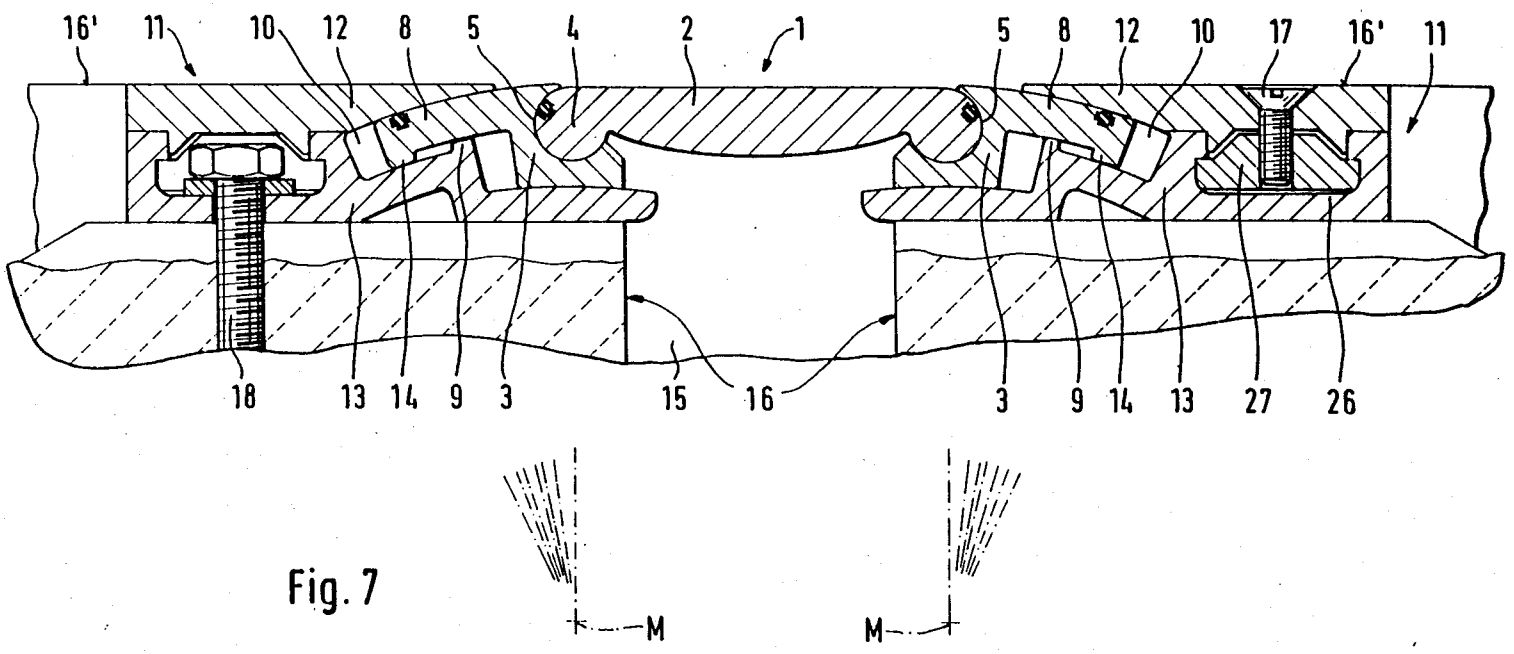

The embodiment example according to FIG. 7 differs from the embodiment example of FIG. 6 essentially in that the anchoring units 11 are in each instance comprised of two cleats 12 and 13 connected detachably with each other through screws 17. To this end in each of cleats 13 are formed undercut grooves 26 into which hammerhead-shaped nuts 27 for receiving screws 17 are inserted.

In all embodiment examples bearing parts of the bridging unit 1 slide on contact surfaces of the anchoring units 1 inclined or rising toward the arrangement center and optionally provided with a coating, whereby at each joint width the upper side of the arrangement without forming steps or interruptions changes smoothly into the structural surface of the structural parts 16 separated by joint 15.

From the foregoing, it will be appreciated that there is described a joint bridging device capable of spanning vertically and horizontally shiftable surfaces wherein a smooth transition between such surfaces is defined in all cases.

I claim:

1. A joint forming device for bridging a space between two generally co-planar surfaces comprising an elongate center part generally rectangular in transverse section and having an upper generally horizontally disposed surface, the longitudinal side margins of said center part including part-cylindrical portions, a side part disposed adjacent each said side margin, said side parts including bearing shell means partially encompassing said part-cylindrical portions for pivotally connecting said side parts to said center parts, an anchoring unit outwardly adjacent each said side part, said anchoring units each including a pair of mutually spaced upper and lower cleats having opposed surfaces defining a slot opening toward a respective said side part, said slots being inclined at acute angles relative to said upper surface of said center part, said side parts each having an outwardly directed lower leg portion slidably received within a said slot of a respective said side part and an upper leg portion superposed over said upper cleat, said upper leg portion being generally wedge shaped in transverse section, said wedge shaped leg portion being of lesser cross section at positions progressively further from said center part.

2. A joint forming device in accordance with claim 1 wherein said lower cleat includes an upper surface defining a support surface slidably engaged by said lower leg portion.

3. A joint forming device in accordance with claim 2 and including complemental abutment means on said side parts and anchor units for retaining said leg of said side parts within said slot of said anchoring unit.

4. A joint forming device in accordance with claim 3 wherein said upper cleat of said anchor portion is detachably connected to the remainder said anchor portion.

5. A device in accordance with claim 3 wherein said anchor portion includes a base member, vertically directed mounting means extending from said base member, and means connected to said cleats for securing said cleats to said mounting means.

6. A device in accordance with claim 3 wherein aid slot is arcuate in transverse section and said upper surface of said lower cleat and the under surface of said lower leg portion are likewise arcuate.

7. A device in accordance with claim 3 and including compressible seal means interposed between said shells and part-cylindrical portion and between at least one slot defining surface of a said cleat and a said leg portion.

8. A joint forming device for bridging a space between two generally co-planar surfaces comprising an elongate center part generally rectangular in transverse section and having an upper generally horizontally disposed surface, the longitudinal side margins of said center part including part-cylindrical portions, a side part disposed adjacent each said side margin, said side parts including bearing shell means partially encompassing said part-cylindrical portions for pivotably connecting said side parts to said center parts, an anchor unit outwardly adjacent each said side part, said anchor units each include a pair of mutually spaced upper and lower cleats having opposed surfaces defining a slot opening toward a respective said side part, said slot being inclined at an acute angle relative to said upper surface of said center part, said side parts including an outwardly directed upper leg portion slidably received within a said slot of a respective said anchor unit and a lower leg portion slidably supported on an upwardly directed surface of said lower cleat, said upper cleats of said anchor units being wedge shaped in transverse section, the narrow portions of said upper wedge shaped cleats being directed toward said center part and forming a portion of the upper surface of said device.

9. A device in accordance with claim 8 and including complemental abutment means on said side part and anchor unit for retaining said upper leg portion of said side part in said slot.

10. A device in accordance with claim 9 wherein said slot is arcuate in transverse section and said lower leg portion and said upwardly directed surface of said lower cleat are complementally arcuately curved.

11. A device in accordance with claim 10 an including compressible seal means interposed between said shells and parti-cylindrical portions and between said upper leg portion and a portion of said anchor unit.

* * * * *